US006716034B2

(12) United States Patent
Casanova, Jr. et al.

(10) Patent No.: US 6,716,034 B2
(45) Date of Patent: Apr. 6, 2004

(54) GRIP PRESSURE DETECTOR ASSEMBLY

(76) Inventors: Manuel M. Casanova, Jr., P.O. Box 1198, Olmito, TX (US) 78575; Hafez Elfarnawani, 84 Industrial Dr., Brownsville, TX (US) 78521

( * ) Notice: Subject to any disclaimer, the term of this patent is extended or adjusted under 35 U.S.C. 154(b) by 78 days.

(21) Appl. No.: 09/728,182

(22) Filed: Dec. 1, 2000

(65) Prior Publication Data

US 2003/0036436 A1 Feb. 20, 2003

(51) Int. Cl.[7] ..... A63B 69/36

(52) U.S. Cl. ..... 434/252; 434/392; 434/365; 473/202; 473/203

(58) Field of Search ..... 434/247, 252, 434/257, 258, 365, 392; 473/201, 202, 203–204, 205–206; 482/5–8, 49; 73/379.01, 379.02

(56) References Cited

U.S. PATENT DOCUMENTS

| | | | | | |
|---|---|---|---|---|---|
| 4,138,118 | A | | 2/1979 | Budney | |
| 4,776,595 | A | | 10/1988 | Wilkins | |
| 4,861,034 | A | | 8/1989 | Lee | |
| 5,221,088 | A | | 6/1993 | McTeigue | |
| 5,322,281 | A | | 6/1994 | Ganger, Sr. | |
| 5,372,365 | A | * | 12/1994 | McTeigue et al. | 434/252 |
| 5,377,541 | A | | 1/1995 | Patten | |
| 5,419,563 | A | | 5/1995 | Abrams et al. | |
| 5,431,395 | A | | 7/1995 | Ganger, Sr. | |
| 5,439,216 | A | * | 8/1995 | Ganger, Sr. | 473/202 |
| 5,439,217 | A | | 8/1995 | Ganger, Sr. | |
| 5,542,676 | A | * | 8/1996 | Howe et al. | 473/202 |
| 5,655,223 | A | | 8/1997 | Cozza | |
| 5,679,004 | A | * | 10/1997 | McGowan et al. | 434/247 |
| 5,681,993 | A | * | 10/1997 | Heitman | 473/202 |
| 5,697,791 | A | * | 12/1997 | Nashner et al. | 434/247 |
| 5,733,201 | A | | 3/1998 | Caldwell et al. | |
| 5,762,563 | A | * | 6/1998 | Holzhausen | 434/252 |
| 5,771,492 | A | | 6/1998 | Cozza | |
| 5,792,000 | A | * | 8/1998 | Weber et al. | 473/223 |
| 5,797,805 | A | * | 8/1998 | Lubell et al. | 434/252 |
| 5,826,578 | A | * | 10/1998 | Curchod | 434/252 |
| 6,033,370 | A | * | 3/2000 | Reinbold et al. | 600/595 |
| 6,126,449 | A | * | 10/2000 | Burns | 434/252 |
| 6,159,016 | A | * | 12/2000 | Lubell et al. | 434/247 |
| 6,224,493 | B1 | * | 5/2001 | Lee et al. | 473/223 |
| 6,416,327 | B1 | * | 7/2002 | Wittenbecher | 434/247 |
| 6,514,081 | B1 | * | 2/2003 | Mengoli | 434/252 |
| 2001/0041622 | A1 | * | 11/2001 | Taylor | 473/201 |
| 2003/0036436 | A1 | * | 2/2003 | Casanova et al. | 473/202 |
| 2003/0054327 | A1 | * | 3/2003 | Evensen | 434/252 |

* cited by examiner

*Primary Examiner*—S. Thomas Hughes
*Assistant Examiner*—Alex F. R. P. Rada, II
(74) *Attorney, Agent, or Firm*—Cox & Smith Incorporated

(57) ABSTRACT

Apparatus and method for training a novice comprising the steps of providing a sports related implement to at least one expert player for executing a sports related movement. Initiating at least one repetition of the movement. Measuring a variable characteristic of the at least one repetition to provide a sequential record of the variable characteristic produced by the at least one expert player. Transferring the sports implement to a novice player to execute the sports related movement. Activating feedback of the sequential record of the variable characteristic during execution of a comparable movement by the novice player to signal deviation of the comparable movement from the sports related movement, thereby providing expert training to the novice player.

23 Claims, 3 Drawing Sheets

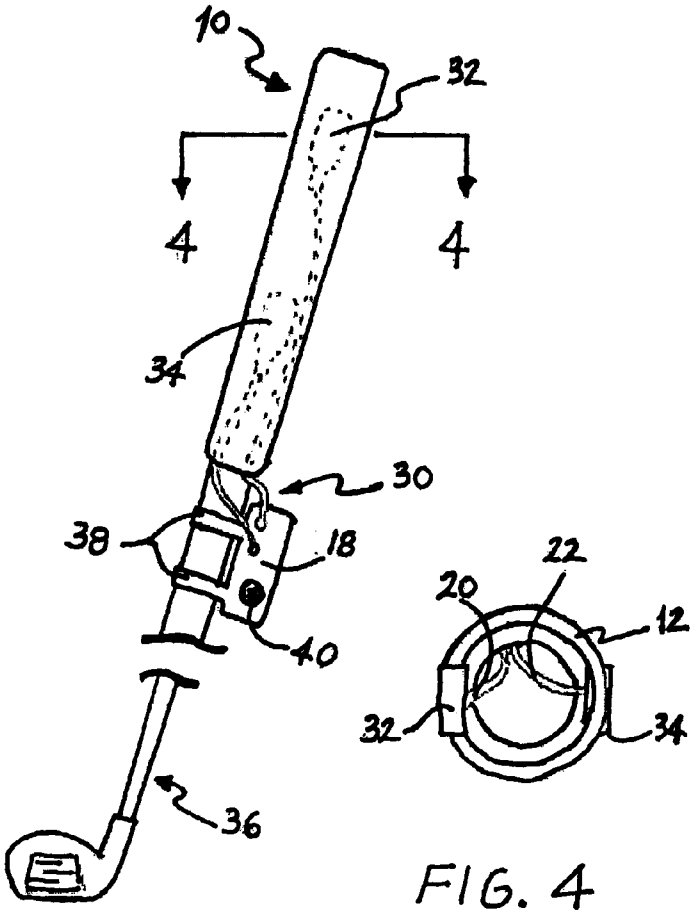
FIG. 4
FIG. 3
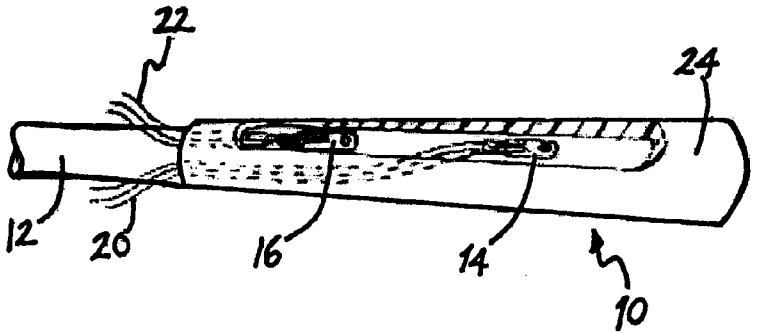
FIG. 1
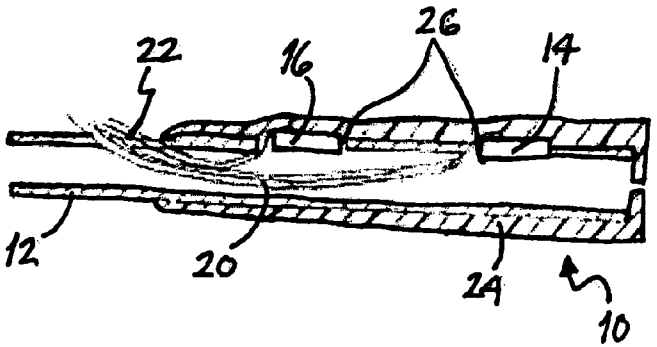
FIG. 2

GRIP PRESSURE DETECTOR ASSEMBLY

BACKGROUND OF THE INVENTION

Technical Field

The present invention relates generally to an apparatus for detecting gripping force associated with holding and swinging sports equipment for transmitting energy generated by a sports participant to a movable object with conservation of maximum energy. More specifically the invention relates to an assembly for detecting the gripping force applied to the handle of an elongate sports implement, such as a golf club, tennis racket, hockey stick, and the like, comparing the gripping force to a previously determined optimum gripping force and signaling any difference between the two.

In the many and varied pursuits of sports and athletics, the drive for improved performance has been aided significantly by the use of feedback to show participants how to relate their technique to achievement of a desired objective. A video camera, for example, may be used in individual sports, such as golf, tennis, and hockey to reveal how a change in body position can be effective in overcoming a weakness in a particular aspect of a chosen, sport. Use of such feedback frequently aids in the development of fundamental actions required for successful participation in a selected sporting activity. Beyond the fundamentals, which can often be appreciated visually, there are subtleties of technique that may have to be sensed in some other way.

Physical activity directed towards achievement in sports often relies upon muscle memory. Muscle memory involves the performance of movement or action accompanied by a desired outcome. A person performing the movement or action thereby recognized how it feels to execute movement that results in a successful outcome. The use of muscle memory allows an individual to experience the subtleties of movement that make the difference between an average result and a superior result.

A number of sporting activities depend upon the transfer of energy from one object to another using an assortment of implements and projectiles. Baseball, for example, uses the energy from a moving, swinging bat to drive a ball away from the bat when there is contact between the two. Similarly, a hockey puck will ricochet from a swinging hockey stick. and a golf ball will be launched by contact with the head of an accelerating golf club. In each case, the hand position and amount of force that a player exerts to grip the bat, stick or club will influence the resultant velocity between the implements of a bat and a ball and the direction in which the ball releases from the bat. It is also recognized that an individual's performance may often times be improved by changing the grip pressure of the hand or hands on the handle of the sports implement.

In search of a home run or the fastest slap shot or the longest drive, players may refine their technique, for greater velocity and distance, by consulting with a sports expert and by using any one of a number of training devices. A wide variety of training devices are known for improving swing fundamentals related especially to the sports of golf and tennis. Training devices may employ means for measuring the magnitude of a signal produced during performance of a given sport. Measurement of a signal usually includes an arrangement or means that provides feedback, often audio feedback, when a signal exceeds a set level. U.S. Pat. No. 4,138,118 refers to a golf swing training device comprising a modified golf club grip. The shaft of the club, in the grip area, includes openings machined in the shaft to accommodate a pair of pressure sensitive transducers. A player gripping the modified grip holds the club so that a pressure transducer is located beneath each of the player's hands. Wires from the transducers exit from the terminal portion of the grip for connection to a monitor that includes a recorder of hand pressure changes occurring during execution of a golf swing. The connecting cord, used between an external recorder and the golf grip, is at risk of becoming entangled with the golfer's arms during the back swing during use.

U.S. Pat. No. 4,861,034 describes a golf grip attachment that preferably wraps around the shaft of a golf club. The attachment comprises a sandwich structure having foam separators between metallic strips. A battery powered alarm responds to a signal produced when there is contact between metal strips resulting from the application of hand pressure. The hardness of the foam separators will influence the amount of hand pressure needed to trigger the audible alarm. This may prevent sensing of subtle pressure changes, rendering the. device of limited training value.

U.S. Pat. No. 5,221,088 provides a complex arrangement of sensors, measurement devices and feedback systems that require attachment to various parts of a golfer's body. To receive audio feedback the player wears a set of earphones. A unit that senses shoulder movement and body tilt may be worn between the player's shoulder blades. Weight distribution sensors, inside the golfer's shoes, provide feedback for correct address before commencing the golf swing. Added to this equipment is a hip mounted control unit that receives signals for encoding from the various sensors. Attempts to simultaneously improve several facets of one's movements using the multiple response device can lead to confused frustration from trying to concentrate on too many different aspects of a golf swing.

U.S. Pat. Nos. 5,322,281; 5,431,395 and 5,439,217 describe a device including a sheet having sensors strategically positioned over its surface to occupy key locations on the handles of either a tennis racket or golf club about which the sheet may be wrapped. The key locations represent points where a player may apply hand pressure while hitting a tennis ball or swinging a golf club. An objective of the device is to notice the application of an optimum amount of pressure to the sports implement, i.e., racket or club, during play. The wrap-around feature of the sheet changes the radial dimension of the object contacting the player's hand. When the sheet is removed, however, the feel of the racket or golf club changes, compromising any benefit derived from practicing with the device. U.S. Pat. No. 5,439,217 discusses other tennis and golf training devices, using means for feedback to the player.

Another golf swing training device, described in U.S. Pat. No. 5,419,563, provides a handle construction comprising an electrically conducting shaft having a plurality of grooves formed annularly therein. The handle is suitably weighted to simulate the weight and inertia of an actual golf club. Resilient separators provide spacers between the electrically conductive shaft and a conductive wrapping. Application of hand pressure, during execution of a golf swing, flattens the separators producing contact between the shaft and the conductive wrapping. Contact between these parts of the swing simulation device activates an indicator that signals when a player's grip exceeds a desired amount of pressure. A device of the type described does not discriminate a specific point of application of too much pressure upon the grip.

The assembly of U.S. Pat. No. 5,377,541 includes a single sensor for detecting grip pressure on the grip portion of a golf club. The sensor may be repositionable at the surface of the club handle and between golf clubs. An indicator, included in the assembly, provides output signaling of a pressure condition exceeding a certain value. A covering extends over the sensor attached to the handle. The assembly includes a connecting wire between the sensor and a battery pack that may be attached outside or inside the shaft of the golf club. As disclosed, a single point sensor limits the area of the grip over which pressure may be sensed during execution of a golf swing.

The previous discussion indicates that currently available training aids for sports such as baseball, golf, tennis and hockey have a variety of disadvantages related to either device complexity or failure to produce a full range of response to applied hand pressure. Still further, there is no method or device disclosed that provide for the taking of an activity "history"from an individual, such as a noted sports figure and/or professional, and then providing an arrangement through which another individual, such as a novice or trainee player, is automatically coached toward replication of the professional's recorded moves.

In view of the above described deficiencies associated with the use of known designs for sports training aids for determining, among other traits, grip pressure, the present invention has been developed to alleviate these drawbacks and provide further benefits to the user. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventionally designed grip pressure monitoring assemblies and incorporates several additionally beneficial features.

A grip pressure monitor according to the present invention provides a compact monitoring assembly contained in a tubular housing that preferably fits inside a hollow handle portion of a sports implement such as a golf club, hockey stick, baseball bat and the like. The tubular housing, through its construction and placement, provides reinforcement to the hollow handle that may be weakened by the machining of openings to accommodate exposure of one or more sensors. Wires from the sensors pass through the openings in the hollow handle for connection to a microprocessor held within the tubular housing. The microprocessor monitors and records micro-volt changes produced by application of hand pressure to the sensors during execution of a movement, such as a golf swing, that is a key element of a sport of choice. Electrical signals may be recorded intermittently or continuously by the microprocessor over the time period spanning from initiation to completion of the movement of interest. Information recorded in this way may later be compared with another movement of the same type to determine the similarity between the two and comparative differences. A preferred use of a grip pressure monitor according to the present invention is the measurement of the hand pressure profile of a professional golfer, tennis player or other sports expert. The microprocessor may store information for a variety of experts, depending on storage capacity. Stored profiles may be used to improve the proficiency of less skilled players.

Although it will be recognized that a grip pressure monitor assembly according to the present invention has application to a number of sports, for convenience, the following description makes primary reference to the use of such a device for producing a more consistent and effective golf swing.

A preferred method for use of a grip pressure detector assembly according to the present invention involves comparison of the hand pressure profile of a novice golfer to that of an expert or professional golfer. When used in this way, the grip pressure detector assembly first measures and records the hand pressure profile of a professional golfer. It will be recognized that the use of an expert will also apply when using the grip pressure detector assembly for other sports. The microprocessor module stores the information generated by an expert golfer. Grip pressure profiles may be stored for any number of expert or professional golfers to be later. used in a comparative mode to improve the proficiency of a less skilled player.

The beneficial effects described above apply generally to the exemplary devices and mechanisms disclosed herein for an activity training aid. The specific methods and structures through which these benefits may be delivered will be described in greater detail hereinbelow.

BRIEF DESCRIPTION OF THE DRAWINGS

The invention will now be described in greater detail in the following way of example only and with reference to the attached drawings, in which:

FIG. 1 is a partial cut-away view of a side elevation of a modified handle of an elongate shaft of a sports implement according to the present invention.

FIG. 2 provides a cross-section of a modified handle of an elongate shaft of a sports implement according to the present invention.

FIG. 3 is a side elevation illustrating a golf club including an electronic module attached to the golf club shaft below a modified handle according to the present invention.

FIG. 4 is a cross sectional view through a modified handle taken along line 4—4 of FIG. 3.

DETAILED DESCRIPTION

Figure 5:
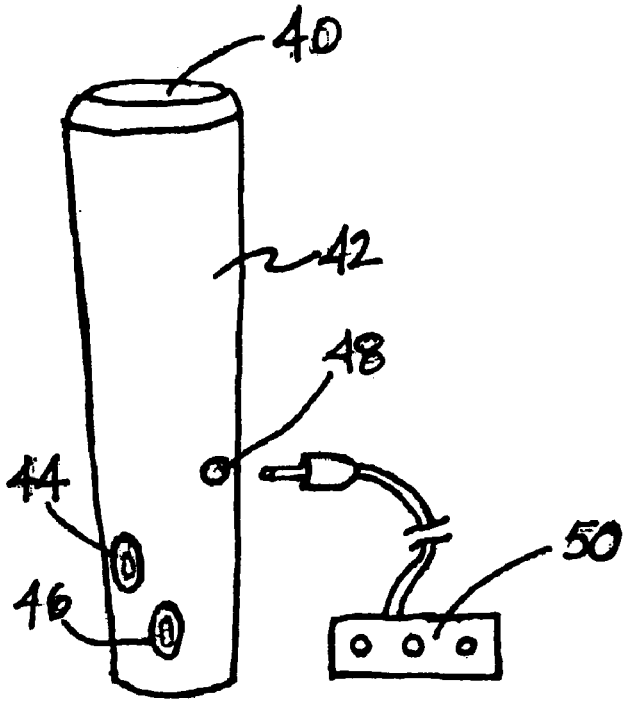
FIG. 5 shows a side elevation of a reinforcing container that includes at least one indicator component.

As required, detailed embodiments of the present invention, including methods and structural arrangements, are disclosed herein. It is to be understood, however, that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as,.a basis for the claims and as a representative basis for teaching one skilled in the art to variously employ the present invention.

Referring to the figures, wherein like numbers refer to like parts throughout the several views, FIG. 1 shows a side elevation of a modified handle 10 including a portion of a shaft 12 that may be attached to a head portion fashioned for a golf club, or sports racket, such as those used for participation in the sports of tennis, squash, badminton, racquetball and the like.

As illustrated in FIG. 1, the modified handle 10 includes positioning a first grip pressure sensor 14 and a second grip pressure sensor 16 adapted for use with a golf club. Use of two sensors may also be appropriate for application to a tennis racket to monitor, or instance, a two-handed backhand stroke. Still further, a single sensor may be utilized when monitoring of two pressure points is not required.

For convenience, further description of a modified handle, according to the present invention, will address its use to provide improvement in developing a reproducible golf swing. During execution of a golf swing, a golfer grips the handle of a golf club with both hands. The act of gripping a golf club will produce a certain amount of tension in the arms and shoulders of the golfer. Too much tension will restrict the golfer's ability to turn, while the application of too little tension could cause the club to slip from the golfer's grasp at any point during the golf swing or at impact between a golf club and a golf ball. Either condition of gripping with too much or too little tension will produce an undesirable result. Excessive tension reduces the distance that a golf ball travels after impact. A loose grip presents the danger that the club itself may become a projectile. While this latter case is readily detected and easily corrected, the amount of grip pressure for driving a golf ball as far as possible is less easy to discern. Different grips, and combinations of grips are also utilized for controlling the travel of the ball after leaving the club head after contact.

Golfers often invest in some form of instruction or training to more quickly acquire the skills that will allow them to drive a golf ball with greater control. Frequently, a professional golfer provides individual instruction of proven techniques that produce a consistent;.golf swing with appropriate results in distance and direction. No matter the quality or price of the professional instruction, while usually beneficial, it does not enable the student golfer to experience or even be able to appreciate with the same sensations of posture, position and grip that which the professional golfer experiences. At best, a teacher may stand behind a student and guide them through a swing, but this "guidance"never replicates an actual swing. The teacher is primarily left to observe the student and try to discern flaws in their form because of the reaction of the struck ball. Corrective and helpful changes in form, power, grip and the like are then suggested to the student. If the activity of the ball improves on the next strike, it is assumed that the student complied with the instruction and is instructed to remember that performance. Any golfer who has undergone such instruction can easily appreciate its drawbacks and the frustrations it presents.

The present invention provides an arrangement through which a student is given direct feedback on his or her matching of a target activity, such as grip pressure utilizing a grip pressure detector assembly.

FIG. 3 includes the components of a grip pressure detector assembly 30 arranged to function according to the present invention. Key components include a modified handle 10 and a microprocessor module 18 having a capability for detecting and recording the intensity of pressure applied to a first grip pressure sensor 14 and a second grip pressure sensor: 16 during execution of a golf swing. The sensors 14,16 form part of the exterior of the modified handle 10 with wiring between the handle 10 and the microprocessor 18.

FIGS. 1 and 2 provide detail of the modified handle 10 showing the preferred positioning of the first sensor 14 and the second sensor 16 for application of pressure by each hand using a conventional golf grip. Preferably, each sensor is a sensitive strain gauge less than lmm thick and made of stainless steel type 301 or half hard beryllium copper. Attachment of the first sensor 14 to the microprocessor 18 using connecting wires 20 and the second sensor 16 with sensor wires 22 produces a battery driven assembly capable of measuring micro-volt changes and may optionally incorporate storing capabilities for recording voltage change with respect to time for each sensor 14,16. The time of interest is that consumed from address to completion of a full golf swing.

Connecting wires 20 and sensor wires 22 may run along the outer surface of the shaft 12 or may be routed inside the hollow shaft 12 before passing through holes bored in the shaft 12, as illustrated in FIGS. 1 and 2. The latter arrangement is preferred when the microprocessor 18 is mounted on the outside of the shaft 12.

A desirable feature of a modified handle 10 according to the present invention is the provision of a handle having the look and feel of a conventionally configured golf club handle. For this reason the modified handle 10 has a conventional cover 24 over the grip portion of the handle 10 and there is minimal protrusion of the sensors 14, 16 above the surface of the shaft 12. With careful preparation, the modified golf handle 10 is barely distinguishable from a golf club handle without modification.

The modified golf club handle 10 includes holes 26 cut into the shaft 12. Removal of material from the shaft may, however, produce structural weakness in the vicinity of the holes 26. For this reason the grip pressure detector assembly 30 includes internal reinforcement of the shaft 12 in the region containing the pressure sensors 14, 16. Preferably, a nylon insert, machined to fit inside the shaft 12, provides reinforcement to maintain the integrity of the shaft 12 of a golf club 36.

FIG. 3 and FIG. 4 show an alternative arrangement of sensors that allows grip pressure produced by the palm of each hand to be sensed. The modified handle 10, in this case, is designed for a right-handed golfer to allow placement of the golfer's left hand higher on the handle 10 than the right hand. With this configuration, a left palm sensor 32 lies on the opposite side of the shaft 12 from a right palm sensor 34. The cross-section of FIG. 4 illustrates the 180° relationship of the left palm sensor 32 to the right palm sensor 34. Connecting wires 20 to the left palm sensor 32 and sensor wires 24 from the right palm sensor 34 pass down the shaft 12 to exit through holes (not shown) in the wall of the shaft 12 for connection to the microprocessor 18.

The microprocessor module 18 may be attached to the shaft 12 of the golf club 36 by straps 38 or other suitable means of attachment. Attachment of the microprocessor requires a suitable means to retain the microprocessor module 18 in contact with the shaft 12 during execution of a full golf swing. The microprocessor module 18 includes a battery, and an integrated circuit device that retains a time based record of changes in pressure generated by the sensors 14, 16, 32, 34 in response to changes in grip pressure applied by a golfer performing a golf swing. A pressure indicator may also be included in the microprocessor module 18 or may be mounted on a golf club 36 at a position separate from the microprocessor module 18. Pressure indicators may take the form of audible alarms, LED color displays, digital readouts and even virtual imaging. The microprocessor module 18 shown in FIG. 3 includes an audible alarm 40 which sounds when the pressure applied to the modified handle 10 deviates from a desired level. The deviation may be positively or negatively away from the desired mark(s).

The grip pressure detector assembly 30 links the sensors 14, 16 in the modified handle 10 to the microprocessor module 18 to produce a record of grip pressure changes exerted by a golfer executing a full golf swing from address position to completion of a full body turn. As the pressure of the hands is applied over the gauges 32, 34 a micro-volt change will occur corresponding to strain gauge displacement. Any changes in pressure may be displayed if the detector assembly 30 includes a visual read-out. The visual read-out may be a digital indicator or dot bar display, installed under the cover 24, to provide feedback to a player of pressure applied by each hand independently. A preferred read-out value can be determined and set for each shot. Optionally, an audible alarm may be used to alert a golfer of deviation from a selected setting during repeated execution of a shot.

Changes in intensity of the alarm, be it visual or aural, may be used to indicated degrees of deviation from the desired target. As an example, as a golfer's grip becomes increasingly tight above the target grip pressure, a single light may be regulated to become increasingly more intense in brightness, an audible alarm may become louder or a sequential dot bar display may be linearly progressed.

FIG. 5 shows a reinforcing insert 42 that may also be used as a container for a microprocessor for recording changes in grip pressure, a battery and an audible warning device 40. Contacts 44, 46 positioned on the outer surface of the container provide points of connection between the grip pressure sensors 14, 16 and the microprocessor 18. A socket 48 allows access to the microprocessor 18 by auxiliary equipment such as a dot bar display 50 or a graphic form of recorder.

Figure 6:
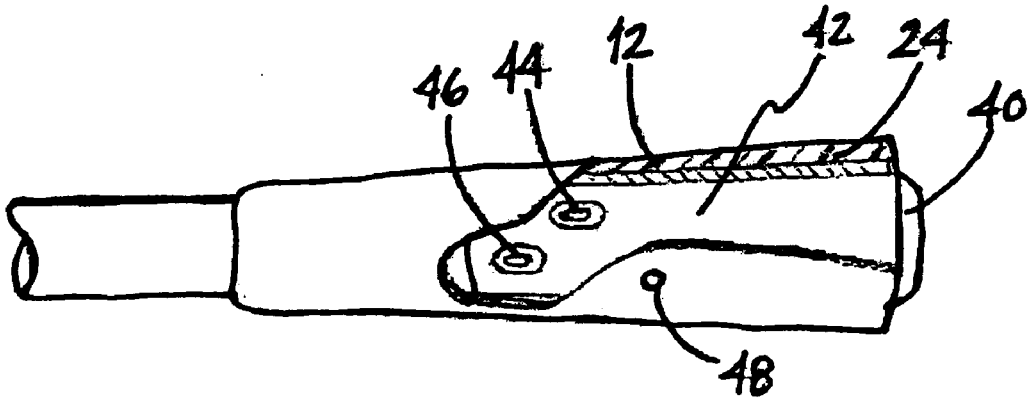
FIG. 6 provides a partial cut-away view illustrating the positioning of a reinforcing container inserted in a modified handle according to the present invention.
Figure 7:
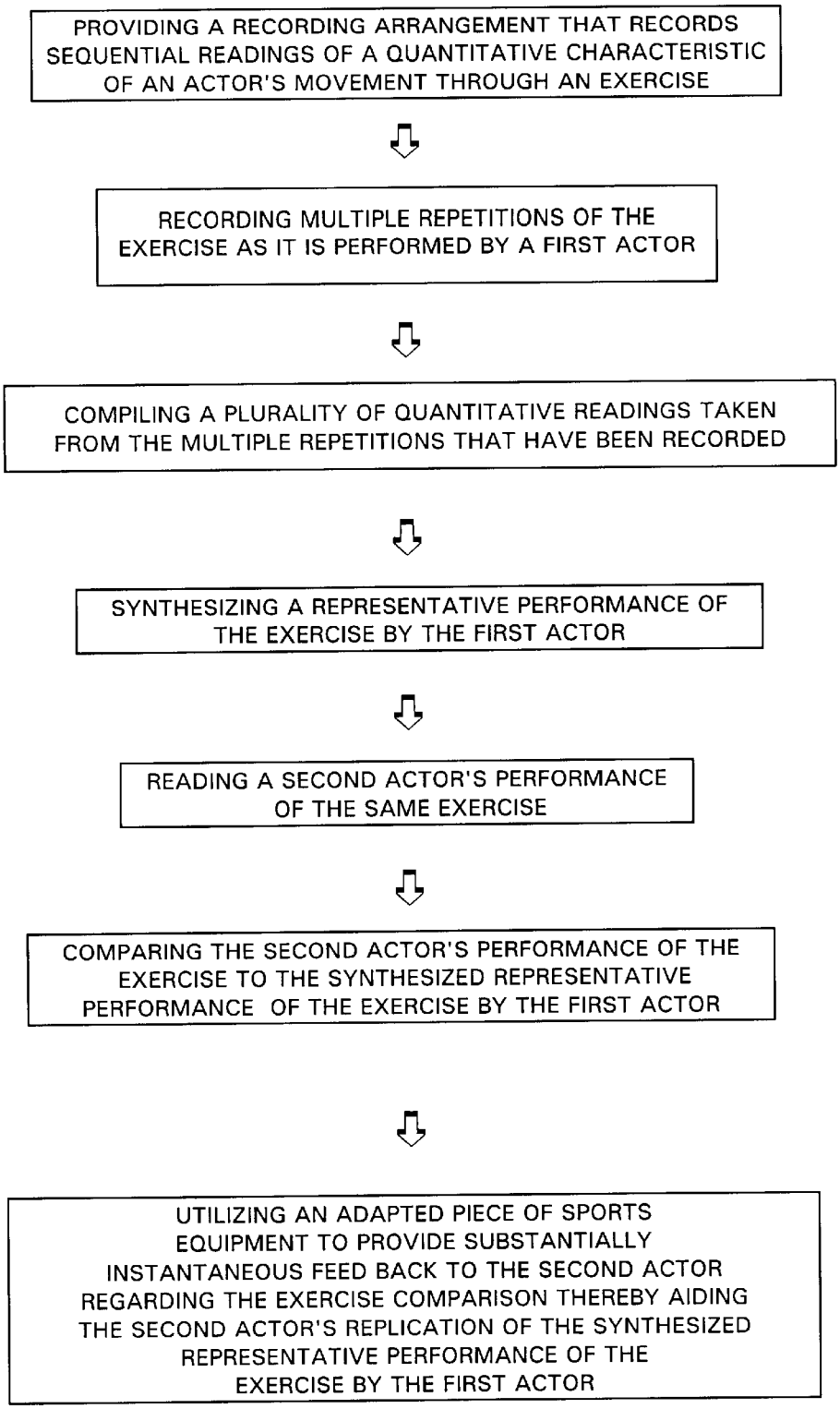
FIG. 7 is a flow chart illustrating aspects of a preferred method of utilization according to the present invention.

FIG. 6 provides a partial cut-away view to illustrate how positioning the reinforcing insert 42 inside the modified handle 10 provides support for the hollow shaft 12 without changing the dimensions of the handle 10.

A handle, containing sensors, should not be lumpy of bumpy but should provide the sensation of an unmodified implement handle. There should be no abnormal feel when holding the handle.

In one embodiment, the invention takes the form of a method for training a person to accurately replicate an exercise as performed by another. The method includes providing a recording arrangement that records sequential readings of a quantitative characteristic of an actor's movement through the exercise. It may begin with recording multiple repetitions of the same exercise as it is performed by a first actor. The method continues by compiling plurality of quantitative readings taken from the multiple repetitions that have been recorded and synthesizing therefrom a representative performance of the exercise by that first actor.

In a subsequent aspect, the method of the invention is continued by reading a second actor's performance of the same exercise. The second actor's performance of the exercise is then compared to the synthesized representative performance of the exercise by the first actor.

The architectural arrangement of the invention is then utilized to provide substantially instantaneous feed back to the second actor regarding the exercise comparison thereby,. aiding the second actor's replication of the synthesized representative performance of the exercise by the first actor. In an alternative, the invention may be configured to notify the second actor of significant deviation from the synthesized representative performance of the exercise by the first actor. The level of significance before the notification is used may be variably set by the user, or permanently set at time of construction.

It is contemplated that the mode(s) by which the feed back is issued to the user may take various forms. These modes include audible signaling, including varying the intensity of the audible signal commensurate with a magnitude of deviation of the second actor's replication from the synthesized representative performance of the exercise by the first actor. Similarly, a visual signal may be utilized, also contemplated to be variable in nature and that may exemplarily include a brightening single light source or a progressive dot bar display in which varying linear progression along the progressive dot bar display signals the magnitude of deviation of the second actor's replication from the synthesized representative performance of the exercise by the first actor. The progression may be bi-direction thereby making it possible to signal deviations in both positive and negative directions away from the target of the synthesized representative performance of the exercise by the first actor.

In a preferred embodiment of the invention, the first actor is an experienced athlete and the second actor is a less experienced athlete desirous of replicating the first actor's proficiency in performing the exercise. In a particularly preferred embodiment of the invention, the first actor is a golf professional and the second actor is a novice golfer desirous of replicating the golf professional's proficiency in performing a golf swing. In this embodiment, the substantially instantaneous feed back may be provided to the second actor, the novice golfer, in the form of a virtual representation of the first actor. The characterization may be cartooned for a more generic display, or it may be customized to resemble a consumer-based desirable first actor. For instance, the likeness of a celebrity golfer may be utilized in the virtual representation as a role model for the student golfer. In this regard, the celebrity may actually have been the first actor, or their likeness may be merely used for commercial purposes.

The method of the invention may be continued by recording a plurality of comparisons for statistical analysis to then be made of the novice golfer's progress toward accurate replication of the synthesized representative performance of the exercise by the golf professional.

From an architectural standpoint, implementation of the method of the invention may be advantageously accomplished through the utilization of an adapted golf club to detect and record the sequential readings of the quantitative characteristic of the golf professional's movement through a golf swing. In a preferred embodiment, the adapted club incorporates a strain gauge for sensing grip pressure upon the adapted golf club by a golfer, be it a professional performing that actions of a first actor or a student player attempting to replicate the actions of professional as a second actor.

A sports training and/or therapeutic device, its components and methods of utilization have been described herein. These and other variations which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

INDUSTRIAL APPLICABILITY

The present invention finds applicability in the athletic and therapeutic industries.

We claim:

1. A method for training accurate replication of an exercise, the method comprising:

providing a recording arrangement that records sequential readings of a pressure of an actor's grip on a sports equipment through an exercise;

recording pressure readings from multiple repetitions of a particular exercise being performed by a first actor using said arrangement; and compiling a plurality of said readings recorded during said multiple repetitions and synthesizing a representative performance of the exercise by the first actor using the compiled readings.

2. The method as recited in claim 1, further comprising: reading a second actor's performance of the exercise; and comparing the second actor's performance of the exercise to the synthesized representative performance of the exercise by the first actor.

3. The method as recited in claim 2, further comprising:

providing substantially instantaneous feed back to the second actor regarding the exercise comparison thereby aiding the second actor's replication of the synthesized representative performance of the exercise by the first actor.

4. The method as recited in claim 2, wherein the recording arrangement is wholly integrated with the sports equipment; and wherein the method further comprises:

providing substantially instantaneous feed back to the second actor regarding the exercise comparison thereby notifying the second actor of deviation from the synthesized representative performance of the exercise by the first actor.

5. The method as recited in claim 4, further comprising:

providing the substantially instantaneous feed back to the second actor in the form of an audible signal.

6. The method as recited in claim 5, further comprising:

varying an intensity of the audible signal commensurate with a magnitude of deviation of the second actor's replication from the synthesized representative performance of the exercise by the first actor.

7. The method as recited in claim 4, further comprising:

providing the substantially instantaneous feed back to the second actor in the form of a visual signal.

8. The method as recited in claim 7, further comprising:

varying an intensity of the visual signal commensurate with a magnitude of deviation of the second actor's replication from the synthesized representative performance of the exercise by the first actor.

9. The method as recited in claim 4, further comprising:

providing the substantially instantaneous feed back to the second actor in the form of a light source.

10. The method as recited in claim 9, further comprising:

varying an intensity of the light source commensurate with a magnitude of deviation of the second actor's replication from the synthesized representative performance of the exercise by the first actor.

11. The method as recited in claim 4, further comprising:

providing the substantially instantaneous feed back to the second actor in the form of a progressive dot bar display.

12. The method as recited in claim 11, further comprising:

varying a linear progression along the progressive dot bar display commensurate with a magnitude of deviation of the second actor's replication from the synthesized representative performance of the exercise by the first actor.

13. The method as recited in claim 4, further comprising:

providing the substantially instantaneous feed back to the second actor in the form of a virtual representation of the first actor.

14. The method as recited in claim 4 wherein the first actor is an experienced athlete and the second actor is a less experienced athlete desirous of replicating the first actor's proficiency in performing the exercise.

15. The method as recited in claim 4 wherein the first actor is a golf professional and the second actor is a novice golfer desirous of replicating the golf professional's proficiency in performing a golf swing.

16. The method as recited in claim 15, further comprising:

recording the comparisons for statistical analysis of the novice golfer's progress toward accurate replication of the synthesized representative performance of the exercise by the golf professional.

17. The method as recited in claim 15, further comprising:

utilizing an adapted golf club to detect and record the sequential readings of the quantitative characteristic of the golf professional's movement through a golf swing.

18. The method as recited in claim 17, further comprising:

incorporating a strain gauge into the adapted golf club for sensing grip pressure upon the adapted golf club by a golfer.

19. The method as recited in claim 4, further comprising:

providing the substantially instantaneous feed back to the second actor in the form of a digital read-out display.

20. The method as recited in claim 19, further comprising:

varying a numerical read-out on the digital read-out display commensurate with a magnitude of deviation of the second actor's replication from the synthesized representative performance of the exercise by the first actor.

21. A method for training a novice comprising the steps of providing a sports equipment to at least one expert player for executing a sports related movement;

initiating at least one said movement;

measuring the expert player's grip pressure on the sports equipment during said movement to provide a sequential record of grip pressure produced by the expert player;

transferring said sports equipment to a novice player to execute a movement comparable to said sports related movement;

activating feedback of said sequential record of grip pressure during execution of said comparable movement by the novice player to signal deviation of said comparable movement from said sports related movement, thereby providing expert training to the novice player.

22. The method of claim 21, wherein, wherein a recording arrangement is wholly integrated with the sports equipment; and said sports equipment is selected from the group consisting of golf clubs, tennis racquets, and hockey sticks.

23. The method of claim 21 wherein said sports related movement is an arcuate movement.

* * * * *